US010945495B2

(12) United States Patent
Frietsch

(10) Patent No.: US 10,945,495 B2
(45) Date of Patent: Mar. 16, 2021

(54) WRISTBAND WITH INTEGRATED POCKET

(71) Applicant: Sydney P. Frietsch, Deer Creek, IL (US)

(72) Inventor: Sydney P. Frietsch, Deer Creek, IL (US)

( * ) Notice: Subject to any disclaimer, the term of this patent is extended or adjusted under 35 U.S.C. 154(b) by 82 days.

(21) Appl. No.: 16/269,543

(22) Filed: Feb. 6, 2019

(65) Prior Publication Data

US 2019/0239601 A1 Aug. 8, 2019

Related U.S. Application Data

(60) Provisional application No. 62/627,562, filed on Feb. 7, 2018.

(51) Int. Cl.
*A44C 5/00* (2006.01)
*A41D 27/20* (2006.01)

(52) U.S. Cl.
CPC ..... *A44C 5/003* (2013.01); *A41D 27/202* (2013.01); *A44C 5/0053* (2013.01); *A41D 2500/20* (2013.01)

(58) Field of Classification Search
CPC .. A44C 5/003; A44C 5/0053; A45F 2005/008
See application file for complete search history.

(56) References Cited

U.S. PATENT DOCUMENTS

| | | | | |
|---|---|---|---|---|
| 3,751,329 | A * | 8/1973 | Fonzi | D06N 3/145 442/370 |
| D888,596 | S | 6/2020 | Frietsch | |
| 2007/0142883 | A1* | 6/2007 | Quincy, III | A61F 7/034 607/96 |
| 2015/0245939 | A1* | 9/2015 | Fruscione-Loizides | A61F 5/02 602/19 |
| 2016/0345704 | A1* | 12/2016 | Aussant | A45D 8/34 |
| 2017/0065041 | A1* | 3/2017 | Coats | A45C 1/04 |
| 2018/0084879 | A1* | 3/2018 | Parr | A45C 11/16 |
| 2018/0235325 | A1* | 8/2018 | Samardzija | A45F 5/00 |

OTHER PUBLICATIONS

Instagram video, Oct. 28, 2016, posted by "Ringbandits" shownig how product is used. see: https://www.instagram.com/p/BMHRMRajr7T/?igshid=1ska96z4pry6o (Year: 2016).*
Instagram post, Dec. 15, 2016, posted by "Ringbandits" noting product for sale. (Year: 2016).*
Instagram post, Apr. 15, 2016, posted by "Ringbandits" noting product closeup. (Year: 2016).*
https://ringbandits.wixsite.com/mysite/shop (published online Nov. 18, 2016).
U.S. Appl. No. 29/627,210, filed Nov. 23, 2017, Granted, U.S. Pat. No. D. 888,596.
U.S. Appl. No. 29/736,599, filed Jun. 1, 2020, Pending.
U.S. Appl. No. 16/997,638, filed Aug. 19, 2020, Pending.

* cited by examiner

*Primary Examiner* — Sarah B McPartlin
(74) *Attorney, Agent, or Firm* — Wendy Thai

(57) ABSTRACT

The invention provides a wristband with an integrated pocket that can be used to store small valuables.

20 Claims, 2 Drawing Sheets

WRISTBAND WITH INTEGRATED POCKET

CROSS-REFERENCE TO RELATED APPLICATIONS

This application claims priority to U.S. provisional application No. 62/627,562, filed Feb. 7, 2018, the contents of which are incorporated herein by reference in its entirety.

BACKGROUND

A wristband is worn on the wrist for a variety of purposes. A wristband can be used as a fashion accessory, as a sweatband, or for identification. Due to the many uses of a wristband, an improved wristband would be desirable.

SUMMARY OF THE INVENTION

The invention provides a wristband with an integrated pocket useful for storing small items including valuables.

In one aspect, the invention provides a wristband comprising a pocket for holding small items affixed to an elastic strap, wherein: (a) the strap comprises a plurality of loops, closely and concentrically assembled and configured to encircle the wrist of a wearer, each loop being formed of a tubular, braided, or woven cording; and (b) the pocket is affixed to a portion of the wrist-facing side of the strap such that the pocket is tucked between the strap and the wrist of the wearer when the wristband is worn on the wrist.

In some embodiments of a wristband of the invention, each loop of the plurality of loops is a discrete, closed loop.

In some embodiments of a wristband of the invention, the plurality of loops is two, three, four, five, six, seven, eight, or nine discrete, closed loops.

In some embodiments of a wristband of the invention, the plurality of loops comprises two or more contiguous loops formed of a segment of cording.

In some embodiments of a wristband of the invention, the plurality of loops is assembled in parallel relation to form the strap, the strap thereby comprising a parallel portion.

In some embodiments of a wristband of the invention, at least two loops in the plurality of loops are assembled in cross relation to form the strap, the strap thereby comprising one or more crisscrosses.

In some embodiments of a wristband of the invention, at least one loop in the plurality of loops comprises two or more segments of cording assembled to form the at least one loop.

In some embodiments of a wristband of the invention, the strap, the integrated pocket, or the strap and the integrated pocket comprise spandex, nylon or spandex and nylon.

In some embodiments of a wristband of the invention, the strap, the integrated pocket, or the strap and the integrated pocket comprise a polyester-spandex blend.

In some embodiments of a wristband of the invention, the strap, integrated pocket, or the strap and the integrated pocket comprise a 4-way stretch material.

In some embodiments of a wristband of the invention, the wristband comprises an outward facing slot through which a small item can be inserted into the pocket.

In some embodiments of a wristband of the invention, the outward facing slot is beneath of one or more loops in the plurality of loops.

In some embodiments of a wristband of the invention, the wristband comprises a slot disposed along a portion of a hand-proximal edge of the pocket when the wristband is on the wrist to enable a small item to be inserted into the pocket.

In some embodiments of a wristband of the invention, the pocket comprises a slot configured with a zipper, a hook and loop fastener, one or more snaps, or one or more buttons.

In some embodiments of a wristband of the invention, the pocket is affixed to the wrist-facing side of strap through stitching.

In some embodiments of a wristband of the invention, the pocket comprises a swath of material to which a zipper is stitched, the edges of the swath of material and the edges of the zipper being co-extensive, the swath of material and the zipper being stitched along their co-extensive edges to form an internal pocket chamber accessible through the zipper, and wherein the stitching securing the swath of material and the zipper along their co-extensive edges secures the pocket to the wristband.

In some embodiments, a wristband of the invention has a parallel portion having five parallel loop segments.

In some embodiments, a wristband of the invention has a crisscross portion.

In some embodiments of a wristband of the invention, the zipper opening is disposed beneath a third loop segment or between a second and a third loop segments.

In another aspect, the invention provides a wristband comprising a pocket for holding small items affixed to an elastic strap, wherein: (a) the strap comprises a plurality of loops, closely and concentrically assembled and configured to encircle the wrist of a wearer, each loop being formed of an elastic cording comprising a fabric weight of at least about 500 grams per square meter; and (b) the pocket is affixed to a portion of the wrist-facing side of the strap such that the pocket is tucked between the strap and the wrist of the wearer when the wristband is worn on the wrist.

Any feature or combination of features described herein are included within the scope of the present invention provided that the features included in any such combination are not mutually inconsistent as will be apparent from the context, this specification and the knowledge of one of ordinary skill in the art.

Unless otherwise defined, all technical and scientific terms used herein have the same meaning as commonly understood by one of ordinary skill in the art to which this invention belongs. In case of conflict, the present specification, including definitions, will control. In addition, the materials, methods, and examples are illustrative only and not intended to be limiting. Although methods and materials similar or equivalent to those described herein can be used to practice the invention, suitable methods and materials are described below.

All patents and publications referenced or mentioned herein are indicative of the levels of skill of those skilled in the art to which the invention pertains, and each such referenced patent or publication is hereby incorporated by reference to the same extent as if it had been incorporated by reference in its entirety individually or set forth herein in its entirety. Applicants reserve the right to physically incorporate into this specification any and all materials and information from any such cited patents or publications.

12-1, 12-2, 12-3 and 12-4 are in generally parallel relation. Loop cording segments 12E and 13E are knotted at their ends forming knot 18.

Figure 1:
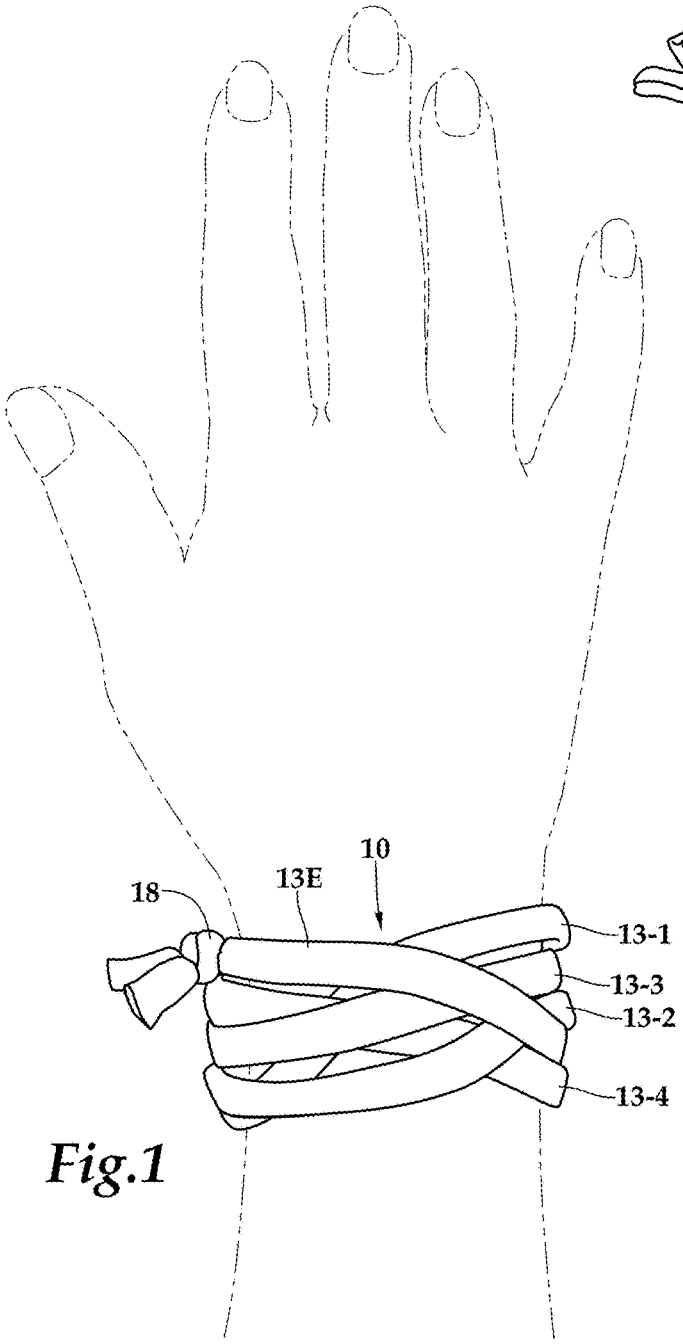
FIG. 1 is a first view of wristband 10 illustrating the crisscross portion of wristband 10 formed by the plurality of loops in which loop cording segments 13E, 13-1, 13-2, 13-3 and 13-4 are in cross relation.
Figure 3:
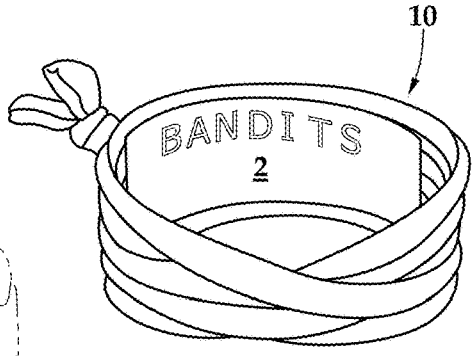

FIG. 3 is a perspective view of wristband 10 from the knotted end illustrating the position of integrated pocket 2, which is affixed to the wrist-facing side of the parallel portion of the strap of wristband 10; integrated pocket 2 is shown with the trademark BANDITS.

Figure 4:
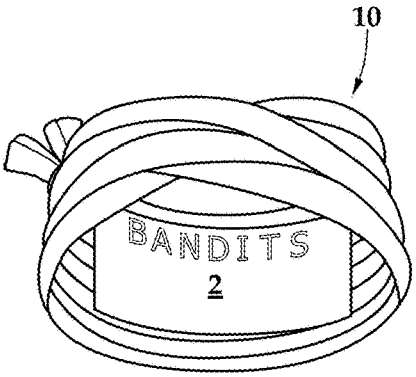

FIG. 4 is a perspective view of wristband 10 from the knot-less end illustrating the position of integrated pocket 2 on the wrist-facing side of wristband 10.

Figure 5:
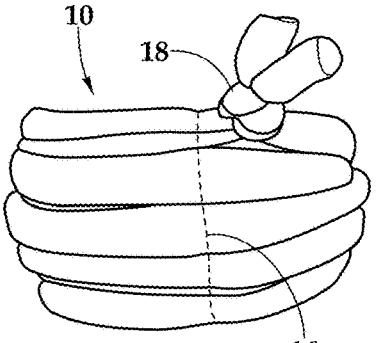

FIG. 5 is a first side view of wristband 10 illustrating a first position of stitching 16, which holds the plurality of loops forming the wristband strap in the select configuration to form the crisscross portion and the stacked portion of the wristband strap, and holds integrated pocket 2 to the wrist-facing side of the strap of wristband 10.

Figure 6:
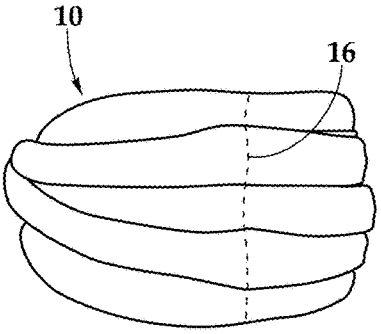

FIG. 6 provide another side view of wristband 10 illustrating a second position of stitching 16, which holds the plurality of loops forming the wristband strap in the select configuration to form the crisscross portion and the stacked portion of the wristband strap, and holds integrated pocket 2 to the wrist-facing side of the strap of wristband 10.

Figure 7:
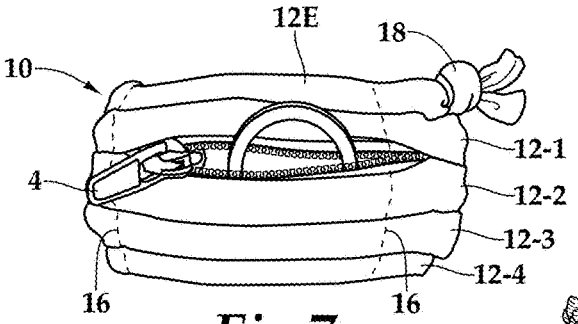

FIG. 7 provides a rear view of wristband 10 and illustrates integrated pocket 2 with zipper 4 in open position with a ring partially inserted into pocket 2, and the two positions of stitching 16, which secures the plurality of loops forming the wristband strap in the select configuration and also secures integrated pocket 2 to the plurality of loops.

Figure 8:
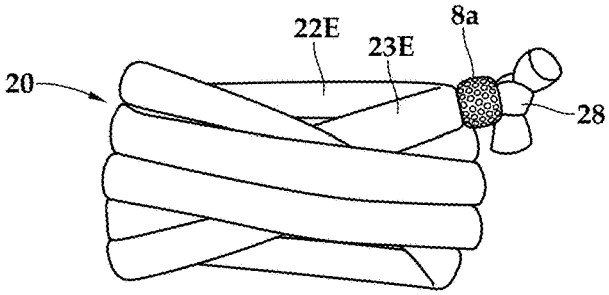

FIG. 8 illustrates another embodiment of the invention represented by wristband 20, which includes integrated pocket 2 (not visible) and barrel ornament 8*a*, which is strung on crisscross strap cording end segment 23E before cording end segment 23E is knotted to cording end segment 22E at knot 28.

Figure 9:
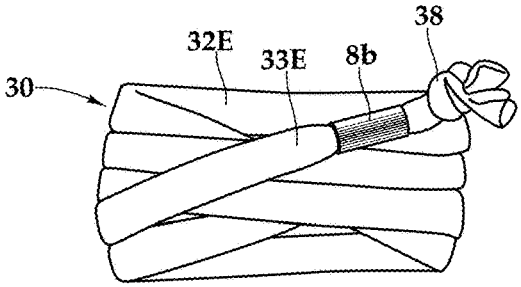

FIG. 9 illustrates another embodiment of the invention represented by wristband 30, with includes integrated pocket 2 (not visible) and cylindrical ornament 8*b*, which is strung on crisscross strap cording end segment 33E before cording end segment 33E is knotted to cording end segment 32E at knot 38.

Figure 10:
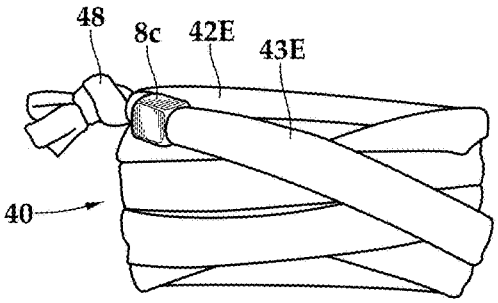

FIG. 10 illustrates another embodiment of the invention represented by wristband 40, which includes integrated pocket 2 (not visible) and block ornament 8*c*, which is strung on crisscross strap cording end segment 43E before cording end segment 43E is knotted to cording end segment 42E at knot 48.

Figure 11:
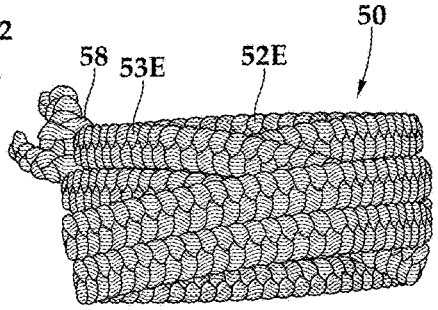

FIG. 11 is a first view of another embodiment of the invention represented by wristband 50, which is constructed with a braided cording, the wristband being constructed with a crisscross portion and a parallel portion.

Figure 12:
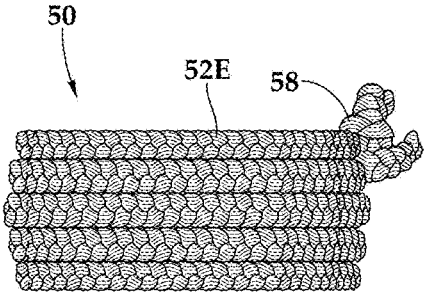

FIG. 12 is a second view of wristband 50, which includes a parallel/stacked portion formed by braided cording as shown, and integrated pocket 2, which is not visible.

Figure 13:
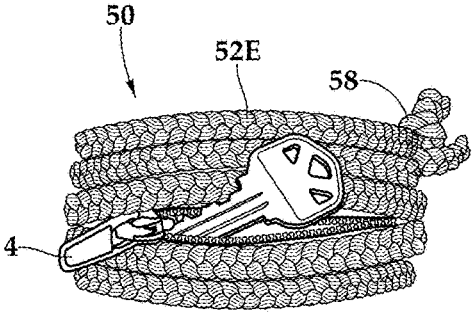

FIG. 13 is another view of wristband 50, which includes integrated pocket 2, the opening of which is located between and/or adjacent to the third and the fourth loops in the plurality of loops forming the wristband strap; integrated pocket 2 with open zipper 4 is shown in open position with a key partially inserted into integrated pocket 2.

DETAILED DESCRIPTION OF THE INVENTION

The invention is based on the discovery that a wristband can be constructed to include a pocket for holding small items. The invention provides a wristband with integrated pocket affixed to the strap of the wristband. In general, a wristband of the invention includes an elastic strap configured to slide over a wearer's hand to be worn on the wrist, though the strap can be configured to slide over wearer's foot to be worn on the ankle, or can fit on an object such as, for example and without limitation, a water bottle, the strap or handle of a bag or a purse, or a cell phone, if not worn on the wrist. A wristband of the invention includes an integrated pocket for holding small items, the pocket being affixed to the strap, for example, to the inner side or wrist-facing side of the wristband strap.

Wristband Strap—Cording Materials

The strap of a wristband of the invention is flexible and stretchy. It is constructed of an elastic cording. As used herein, the term stretchy or elastic in reference to fabric or material for a cording of the invention means the fabric or material can be stretched or extended by any mount, for example, by about 5%, 10%, 15% 20%, 25%, 30%, 35% 40%, 45%, 50%, 55% 60%, 65%, 70%, 75% 80%, 85%, 90%, 95%, 100% its original length, and up to seven times its original length, before recovering its original length when released or tension is removed.

Any elastic material can be used for the cording including, for example and without limitation, materials such as spandex, elastane yarn, rubber core yarn, or a stretchy yarn of polyester, nylon or a natural fiber. The cording can be constructed of a synthetic material such as spandex with various elastane content including between about 1% to about 20%, for example, and without limitation, about: 1%, 2%, 3%, 4%, 5%, 6%, 7%, 8%, 9%, 10%, 11%, 12%, 13%, 14%, 15%, 16%, 17%, 18%, 19%, and 20%. The cording can be constructed of spandex blends, i.e. spandex fibers blended with natural or synthetic fibers including cotton, linen, silk and wool. Non-limiting examples of spandex blends include: cotton-spandex blends with percentage of spandex between about 1 to about 7%, for example, about: 1%, 2%, 3%, 4%, 5%, 6% and 7%; and nylon-spandex blends with percentage of spandex between about 10 to about 20%, for example, about: 1%, 2%, 3%, 4%, 5%, 6%, 7%, 8%, 9%, 10%, 11%, 12%, 13%, 14%, 15%, 16%, 17%, 18%, 19%, and 20%. Cording can also be constructed of other spandex blends including, for example and without limitation: polyester-spandex blend, rayon knit-spandex, acetate-spandex, modal-spandex, tencel-spandex, linen-spandex, cotton-polyester-spandex (stretch denim), poplin-cotton-spandex (cotton poplin stretch).

As used herein, the term "about" in reference to a numeric value means within 10% of the specified value. A number is "about" a reference value if the number is within a range that is + or −10% of the reference value.

The cording or cording material can be water-resistant or water repellant material including, for example, wet suit material, rubber or a synthetic polymer. The cording can be constructed of water resistant material such as rubber or latex. The cording can be constructed of rubber core yarns. The cording can be constructed of a synthetic polymer such as, for example and without limitation, neoprene rubber.

The cording can be constructed of knit fabric including, for example and without limitation, 3×3 rib knit, bamboo jersey, doubleknit rayon blend, interlock twist jersey, double knit, sweater knit, silk mesh knit, silk jersey. The cording or cording material can be constructed of an absorbent material such as, for example, stretch terry cloth.

The cording material can be lycra, cotton, polyester, nylon, rayon, viscose, Dry Fit polyester, bamboo, supplex, tactel, organic cotton, tencel, polyamide, Power Net, Power Mesh, leg elastic, Revolutional Slim (anti-cellulite fabric), or any combination thereof.

The cording can be produced from fabric or material having any of the forgoing material at about the following percentages: 1%, 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, 30%, 31%, 32%, 33%, 34%, 35%, 36%, 37%, 38%, 39%, 40%, 41%, 42%, 43%, 44%, 45%, 46%, 47%, 48%, 49%, 50%, 51%, 52%, 53%, 54%, 55%, 56%, 57%, 58%, 59%, 60%, 61%, 62%, 63%, 64%, 65%, 66%, 67%, 68%, 69%, 70%, 71%, 72%, 73%, 74%, 75%, 76%, 77%, 78%, 79%, 80%, 81%, 82%, 83%, 84%, 85%, 86%, 87%, 88%, 89%, 90%, 91%, 92%, 93%, 94%, 95%, 96%, 97%, 98%, 99%, and 100%.

The cording can be constructed from fabric having spandex, elastane, Italian lycra, spandura, equestrian lycra, wicking lycra, cotton lycra, supplex lycra, super stretch spandex, Poly Net, Poly Mesh, leg elastic, or any combination thereof at about the following percentages, for example, about: 2%, 3%, 4%, 5%, 6%, 7%, 8%, 9%, 10%, 11%, 12%, 13%, 14%, 15%, 16%, 17%, 18%, 19%, 20%, 21%, 22%, 23%, 24%, 25%, 26%, 27%, 28%, 29%, 30%, 31%, 32% 33%, 34%, 35%, 36%, 37%, 38%, 39%, and 40%. For example, cording can be formed from material having 81.2% nylon and 18.8% spandex.

The spandex, elastane or stretchy yarn content of cording can be selected to achieve a percentage of stretch between about 10% to about 50%, or preferably, between about 20% to about 35%, for example, about: 21%, 22%, 23%, 24%, 25%, 26%, 27%, 28%, 29%, 30%, 31%, about 32%, 33%, 34%, or 35%.

Cording material can also be constructed of fold over elastic (FOE) having a heavier weight, for example and without limitation, a weight over about: 350 grams per meter square (GSM), over about 375 GSM, over about 400 GSM, over about 450 grams per meter square (GSM), over about 475 GSM, over about 500 GSM, over about 550 GSM, or over about 600 GSM. Cording material can also be constructed of FOE having greater thickness, for example and without limitation, a thickness of about 1/32 inch, over about 1/32 inch, about 1/16 inch, or over about 1/16 inch.

The cording can have a solid color, any abstract or non-abstract print, or a finishing selected to achieve a particular appearance such as a distressed appearance, a vintage appearance, or a burnout or laser cut appearance. The cording can have a solid color or an acid-washed color. Where the cording has a tubular structure with an internal pore, the internal pore can be hollow or can contain support or cushion material of any color, look or feel. Where the cording comprises two or more strands of material twisted, braided or woven together, each strand can have a different color and/or print. For example, a red, a white and a blue strand of cording material can be braided to form cording for a strap or wristband resembling Americana spiritwear. The strap or wristband of the invention can customized by incorporating one or more colors, print or design to reflect team color(s) and/or to indicate association or support of any select cause, organization or institution.

Wristband Strap—Cording Structure

The cording forming the wristband strap of the invention can have a tubular structure. Where constructed of fabric, the cording can be formed from an elongated strip of cording fabric. The longitudinal edges of the elongated strip can be sewn using a serger, right side (i.e. printed side) of material opposing (i.e. together), to form a serged hem and an elongated tube-like structure with a hollow interior. When turned right side-out, the serged longitudinal hem occupies the interior bore of the tubular cording, and provides support for the tubular cording.

The cording can be formed using multiple strips of cording material woven, twisted, or braided together, for example, two, three or more than three strips of material or any number of strands of thread, yarn or material. The strips of material woven, twisted or braided together also can have a tubular structure.

The strap of a wristband of the invention has a structure that includes a plurality of loops formed of the elastic cording. The wristband strap can be constructed using coding that is in the form of two or more discrete, closed loops that are closely and concentrically assembled. The wristband strap can be constructed using a single, linear segment of cording arranged in a series of turns to form a sequence of contiguous, concentric loops such as that in a spiral, coil, or helix, the concentric loops being closely assembled, and the linear segment of cording having a first and a second end. The wristband strap also can be constructed using multiple or a plurality of short segments of cording that can be assembled end to end and/or closely in parallel or stacked relation to form a circular wristband of a select width.

As used herein, the term "discrete, closed loop" means refers to a curved structure having no terminus akin to that of, for example, a ring, a circle, a torus, an oval, a triangle, a square, a rectangle, a pentagon, a hexagon, a heptagon, an octagon, a nonagon, and a decagon.

As used herein, the term "closely" or "closely assembled" in reference to cording means cording that are assembled with little or no space in between adjacent cording. The term "concentric," "concentrically arranged," or "concentrically assembled" means positioned so as to have a common center.

Whether comprising a plurality of discrete closed loops, a single segment of cording, or a plurality of cording segments assembled end to end and in parallel, the closed loop cordings or cording segments can be secured in a select arrangement by stitching, using an adhesive, or other form of bonding, to form a strap that can be worn around the wrist.

Whether constructed using two or more discrete, closed loops or constructed using a linear segment of cording, the wristband strap has a plurality of concentric loops, for example, two, three, four, five, six, seven, eight or nine concentric loops. Thus, as used herein, the term "plurality of concentric loops" means two or more discrete closed loops, as well as two or more contiguous, concentric curves that can be formed by a linear, cording segment or a plurality of linear cording segments.

Figure 2:
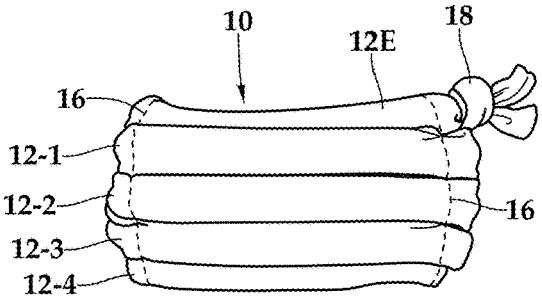
FIG. 2 is a second view of wristband 10 illustrating the parallel or stacked portion of wristband 10 formed by the plurality of loops in which loop cording segments 12-E.

The plurality of concentric loops can be closely arranged in generally parallel relation or in cross relation. The plurality of concentric loops is in generally parallel relation when the loops or segments of cording do not cross. The plurality of concentric loops is in cross relation when two or more of the loops or cording segments cross.

Where the plurality of concentric loops is arranged in generally parallel relation, the wristband strap can have parallel portion with a "stacked" configuration as shown in FIG. 2. The entire circumference of the wristband strap can have a stacked configuration as shown in FIG. 2. Alternatively, a portion of the wristband strap, i.e. a portion of the circumference of the wristband strap, can have a stacked configuration.

Where the plurality of loops is closely and concentrically arranged in cross relation to form one or more crisscrosses, the one or more crisscrosses can be evenly or unevenly spaced along the circumference of the wristband strap. For example, the crisscrosses can be evenly spaced along the entire circumference of the wristband strap. Alternatively, the crisscrosses can be clustered in a portion of the circumference of the wristband strap resulting in a wristband strap having a portion with a crisscross configuration, i.e a crisscross portion, and a portion with a stacked configuration, i.e. a stacked portion.

Whether arranged in generally parallel relation or in cross relation, the loops in the plurality of loops are closely spaced, and each loop in the plurality of loops can overlapping with an adjacent loop along a portion of their arc lengths or circumferences, or along the entire lengths or circumferences.

The plurality of loops can be maintained in any select configuration using any convenient means including, for example, stitching, adhesive, heat bonding, knotting, one or more fasteners or any combination thereof.

In sum, a wristband strap has a plurality of loops, which can be (1) two or more, for example, two, three, four, five, six, seven, eight, nine or more than nine discrete, closed loops closely and concentrically assembled and secured in generally parallel relation, cross relation, or parallel and cross relation; (2) a sequence of two or more, for example, two, three, four, five, six, seven, eight, nine or more than nine contiguous curves formed by a linear segment of cording also closely and concentrically arranged in generally parallel relation akin to a spiral, in cross relation, parallel relation, or in parallel and cross relation, as discussed herein and illustrated in the drawings. In any embodiments, the plurality of concentric loops can be fully overlapping, i.e. along the entire circumference of the loops, or partially overlapping, i.e. along a portion of the circumference of the loops.

Fastener

The plurality of loops can be maintained in a select configuration using any fastening means including stitching, an adhesive, heat bonding, knotting, one or more fasteners, or any combination thereof.

For example, each concentric loop in the plurality of concentric loops can be secured to one or more adjacent concentric loops. Each concentric loop in the plurality of concentric loops also can be secured to a backing, to a label, to a pocket panel, or any combination thereof. Where stitching is used, the stitching can be in any direction useful for maintaining the concentric loops in a select configuration including longitudinally, transversely, or diagonally with respect to the length of the cording. Any type of stitching can be used including those that utilize two or more threads to create a two-, three-, four- or five-thread seam, to generate a straight seam, a seam with some stretch capability such as a serged seam, a chain stitch, safety stitch, or an overlock edge.

One or more fasteners also can be used to maintain the wristband strap in a select configuration. The fastener can be solely functional or also have an ornamental purpose. For example, a bead, charm or decorative link with a central bore can be used to anchor one end of cording to adjacent cording or to another end of cording. More specifically, a cording end that is threaded through the central bore of a device can be knotted to anchor the cording to any other portion of the strap that is also secured to the device.

Knotting or tying of one cording region to another can also be used to maintain the structure of the wristband strap. For example, the ends of a linear cording can be knotted together to form the wristband strap.

Fastening means for maintaining the structure of the wristband strap in a select configuration can be used at any convenient position on the strap. For example, where the plurality of loops is maintained in a stacked configuration in one portion of the wristband and in crisscross configuration in the other portion of the wristband, the plurality of loops can be fixed or held in place in two positions by stitching or fusion of adjacent cording surfaces or by heat bonding or using an adhesive. The two positions where the loops are stitched, fused or bonded together function to define the stacked portion and the crisscross portion and can be about 90-180 degrees apart on the wristband, for example, at about 100 degrees, about 110, about 120 degrees, about 130 degrees, about 140 degrees, about 150 degrees, about 160 degrees, or about 170 degrees apart. The stacked portion of the strap can account for about 15%, about 20%, about 25%, about 30%, about 35%, about 40%, about 45%, about 50%, about 55%, about 60%, about 65%, about 70%, about 75%, about 80%, about 85% of the circumference of the strap, while the crisscross portion can account for about 85%, about 80%, about 75%, about 60%, about 55%, about 50%, about 45%, about 40%, about 35%, about 30%, about 25%, about 20% or about 15% of the circumference of the strap.

Thus, a wristband strap can be constructed of a single cording arranged and held in place as described above to form three, four, five, six or more than six concentric curves to form a wristband with three, four, five, six or more than six segments having a stacked appearance, respectively, on one side or portion of the wristband, and any number of crisscross segments on the other side or remaining portion of the wristband. Alternatively, the strap can be constructed of a plurality of discrete, closed loops, for example, three, four, five, six or more than six loops discrete, closed loops concentrically arranged and held in place as described above to form a wristband with three, four, five, six or more than six stacked segments, or a combination of similar numbers of stacked segments and crisscrossed segments.

Where a wristband is constructed of a single, linear cording, the cording can any useful length, which can be selected based on the number of contiguous concentric loops/wristband segments desired and the size of the wristband or width of the wristband opening. Where a wristband is constructed of a single, linear cording, the cording can have a length of about: 20 inches, 21 inches, 22 inches, 23 inches or more than 23 inches in length. Each of the stacked segments forming a portion of the wristband strap can be about 2.4 inches, about 2.6, about 2.8 inches, about 3 inches, about 3.2 inches, about 3.4 inches, or more than about 3.4 inches in length thereby enabling a hidden pocket opening slightly less than about 2.4 inches, about 2.6, about 2.8 inches, about 3 inches, about 3.2 inches, about 3.4 inches in length.

Integrated Pocket

A wristband of the invention includes an integrated pocket for holding small items affixed to the strap of the wristband. The integrated pocket can be affixed to the strap between the wrist-facing side of the wristband strap and the wrist of the wearer. As such the integrated pocket can be partially or mostly hidden.

The pocket can be formed using the same or different material used for the wristband strap as disclosed above.

The pocket can be any shape or dimension so long as it fits comfortably between the strap and the wrist of the wearer. The pocket can be constructed with a thin profile, in which case, its dimensions or footprint would be no greater than that of the wristband strap. In some embodiments, the pocket need not be hidden or have a thin profile, in which case, the pocket can have any shape, dimension or structure including a pocket with one or more foldable or collapsible sides.

Thus, in some embodiments, the pocket can be formed by securing a swath of material of a select size to a portion of the wrist-facing side of the wristband strap. As such, a pocket chamber for storing small items is formed between the wristband strap and the swath of material. The pocket can also be formed by securing two swaths of material of similar or different select sizes to a portion of the wrist-facing side of the wristband strap. The pocket chamber for storing small items is then formed between the two swaths of material, as well as between the inner swath and the wristband strap. The pocket can be formed by securing one or more swaths of material to the wrist-facing side of the wristband strap so as to form a pouch or an accordion-style pocket rather than a flat pocket. As such, the pouch can be folded or collapsed to a flatter or thinner profile when on the wearer's wrist. The pocket can be formed by stitching a swath of material to a zipper along their edges to form a pocket chamber between the swath of material and the zipper/tape of the zipper.

More specifically, the pocket is first formed by securing a swath of material to a zipper, specifically the tapes of the zipper, along their edges to form a pocket chamber between the zipper and the swath of material. In these embodiments, each tape of the zipper can be secured to an adjacent or cording segment thereby forming an opening between adjacent or stacked coding segments accessible through the zipper.

The pocket can be constructed with an opening for accessing the pocket chamber. The opening can be an outward-facing slot accessible between adjacent segments of cording as shown in FIG. 7. The opening can be on an edge of the pocket, for example, a portion of the edge nearest to the hand of the wearer, i.e. hand-proximal edge, or a portion of the edge farthese from the hand of the wearer, i.e. the hand-distal edge of the pocket. As such, the wearer can insert a small item such as a ring or a folded bill by sliding it into the pocket in a direction along the forearm, for example, from the wrist to the elbow, or elbow to wrist.

The opening can be fitted with a fastener to enable items to be securely held in the pocket chamber. Fasteners useful for securing the opening of the pocket include, without limitation, a zipper, a hook-and-loop fastener, a button- or toggle-and-loop combination, one or more hook and eye fasteners, one or more snaps or poppers, or any combination thereof. In some embodiments, an adhesive or a spring mechanism can be used.

In other embodiments, the opening is not fitted with a fastener. In these embodiments, items stored in the pocket such as a small piece of jewelry or a folded dollar bill can be held smugly though compression of the wristband, strap or cording material on the wrist and/or through steric hindrance presented by the two- or three-dimensional structure of the wristband, strap, cording or wrist.

The pocket can be used to hold small items or valuables such as a ring, earrings, other jewelry, one or more coins, cash, a key, or an identification card.

In general, a wristband of the invention includes an elastic strap configured to slide over a wearer's hand to be worn on the wrist. A wristband of the invention can also be configured to slide over wearer's foot to be worn on the ankle, or can fit on an object such as, for example and without limitation, a water bottle, the strap or handle of a bag or a purse, or a cell phone, if not worn on the wrist. As such, the wristband can be used for identification purposes, as well as to hold valuables or other small items.

The invention is illustrated in the following Examples, which do not limit the scope of the invention set out in the claims.

EXAMPLES

Example 1—Wristband 10

FIGS. 1-7 provide several views of wristband 10. Wristband 10 has a crisscross portion formed by cording segments 13E, 13-1, 13-2, 13-3 and 13-4 (FIG. 1), and a parallel or stacked portion formed by wristband segments 12-E, 12-1, 12-2, 12-3 and 12-4 (FIG. 2). Cording segments 12-E, 12-1, 13-2, 12-3, and 12-4, for example, are arranged in generally parallel relation to achieved a "stacked" appearance" in the parallel or tacked portion of wristband 10. Cording segments 13-E, 13-1, 13-2, 13-3, and 13-4 are arranged in cross relation to form the crisscross portion. The crisscross and stacked portions of wristband 10 are maintained through the two seams 16 (FIGS. 2, 5 and 6) and knot 18, which is formed at cording ends 12E and 13E. Wristband 10 is constructed with a knotted end, a knot-less end and integrated pocket 2 on the wrist-facing side. Perspective views of the knotted and knot-less ends, as well as the position of integrated pocket 2 are shown in of FIGS. 3 and 4. Integrated pocket 2, useful for holding small items, is formed on the wrist-facing side of the strap of wristband 10 as shown in FIGS. 3-4. As such, it is partially or mostly hidden from view (FIG. 2) unless open (FIG. 7). FIG. 7 provides a view of wristband 10 in which the integrated pocket 2 is opened and accessible though open zipper 4. Integrated pocket 2 may include a trademark, a label, or an inspirational message, symbol, or a personalized element. The positions of stitching 16, which secure integrated pocket 2 to the wristband strap, and also maintains the configuration of wristband segments that form the crisscross and the stacked portions are illustrated in side views of FIGS. 5 and 6.

Example 2—Wristbands with Crisscross Configurations and Ornament

Additional examples of a wristband of the invention constructed using a tubular cording are illustrated in FIGS. 8-10.

A wristband of the invention can have any crisscross configuration as exemplified by wristbands 20, 30 and 40, which differ in their crisscross configurations and in the style of ornament incorporated. Wristband 20 (FIG. 8) is constructed with integrated pocket 2 on the wrist-facing side of the wristband strap (not visible) and includes barrel ornament 8*a*, which is strung on crisscross segment 23E before it is knotted to segment 22E at knot 28. Wristband 30 (FIG. 9) is constructed with integrated pocket 2 on the wrist-facing side of the wristband strap (not visible) and includes cylindrical ornament 8*b*, which is strung on crisscross segment 33E before it is knotted to segment 32E at knot 38. Wristband 40 (FIG. 10) is constructed with integrated pocket 2 (not visible) on the wrist-facing side of the wristband strap and includes block ornament 8*c*, which is strung on crisscross segment 43E before it is knotted to segment 42E at knot 48.

Example 3—Wristband with Braided Strap

FIGS. 11-13 provide three views of wristband 50, which is constructed using cording formed by braiding of three subsegments together. Wristband 50 includes a crisscross portion (FIG. 11) and a stacked portion (12). Zipper 4 is located between stacked segments 102 and allows access to integrated pocket 2.

Example 4—Method of Constructing a Wristband with Integrated Pocket

A wristband with an integrated pocket of the invention was constructed with an opening accessible through a zipper. The wristband with integrated zippered pocket was constructed by marking a linear cording segment into shorter portions of about equal lengths or alternating portions of two lengths, i.e. a short length and a longer length. The top and bottom tapes of the zipper can be sewn to a first portion of the marked cording and a second portion of the marked cording, respectively, wherein the first portion and the second portion are one marked cording portion apart on the marked linear cording. As such, the zippered opening is positioned between adjacent cording loop segments on one side of the wristband.

Alternatively, the top zipper tape can be sewn to a select first cording portion, and the bottom zipper tape can be sewn to a select second cording portion, wherein the first cording portion and the second cording portion are three portions apart on the marked linear cording. A wristband of the invention can be constructed by sewing the zipper tapes to cording segments that are three or five segments apart. Typically, the top and bottom strips of the zipper are sewn to segments of equal lengths, for example to shorter length segments one, three or five segments apart as these segments form the stacked portion of the wristband.

Example 6—Wristbands with Integrated Pocket of the Invention

The following provides a summary of exemplary wristbands of the invention constructed with select cording materials identified in the table below.

| | |
|---|---|
| Dark Sky:<br>Corvito 66, style #10105, BLACK<br>80% Nylon 66/20% Spandex<br>Weight 190 GSM<br>Width 58/60"<br>Cool Sensation Touch | Silver Fox:<br>10150 SH Silver (Shiny) Tricot<br>80%, Nylon 20% 032<br>82% Nylon, 18% Spandex<br>Weight 210 GSM<br>Width 58/60"<br>Durable 4-way stretch shiny fabric with smooth texture |
| Blushing Babe:<br>10100 SP Blush<br>82% Nylon, 18% Spandex<br>Weight 210 GSM<br>Width 58/60"<br>50+ | Garden Grace:<br>English Garden Brown<br>#10100, SP 013<br>Polyester Spandex<br>Width 58/60" |
| Vintage Pop:<br>Zippy Tee<br>Polyester Spandex<br>Width 58/60" | Periwinkle:<br>Gypsy<br>82% Nylon, 18% Spandex<br>Weight 210 GSM<br>Width 58/60"<br>50+<br>4-Way Stretch Nylon Spandex<br>Matte Tricot is Durable<br>4-way stretch shiny fabric with smooth texture. |
| Camo:<br>Nylon/Spandex (25%/75%)<br>4 way stretch<br>Weight Medium<br>Width 60"<br>Cool, Stretchy | Floral Paisley:<br>Nylon/Spandex (50%/20%)<br>4 way stretch<br>Medium<br>60"<br>Cool & stretchy<br>Lovely small floral paisley print on a dusty purple background. Swimsuit fabric with a cool hand and 4-way stretch. |
| Shiny Rainbow:<br>Nylon/Spandex (25%/75%)<br>4 way stretch<br>Weight Medium<br>Width 60"<br>Cool, Stretchy<br>Gorgeous shiny blended vertical stripes in mint, light purple, light peach, and light yellow. Quality swimsuit fabric with a cool hand and 4- way stretch. | Aqua Blue:<br>Nylon/Spandex (25%/75%)<br>4 way stretch<br>Weight 9.4 oz/yd<br>Width 60"<br>Cool, Stretchy<br>Beautiful aqua blue tie dye print on quality nylon spandex swimsuit fabric with 4-way stretch. |
| Black & White Plaid:<br>Gingham Check- black/white<br>Polyester Spandex<br>240 GSM<br>58/60" | |

Other Embodiments of the Invention

The materials, methods, examples and embodiments described herein are illustrative and not intended to be limiting. Methods and materials similar or equivalent to those described herein can be used to practice the invention. The invention described herein may be practiced in the absence of any element or limitation that is not specifically disclosed as essential. The methods described herein may be practiced in differing orders of steps. Any combination of elements described herein that does not render the invention inoperable as apparent from context, this specification and to those skilled in the art is included within the scope of the invention. The invention also has been described broadly and generically herein. Each narrower species and subgeneric groupings falling within the generic disclosure form part of the invention. As used herein, the singular forms "a," "an," and "the" include plural reference unless the context clearly dictates otherwise. The term "about" in reference to a numeric value means within 10% of the specified value. A number is "about" a reference value if the number is within a range that is + or −10% of the reference value.

What is claimed is:

1. A wristband comprising a pocket for holding small items affixed to an elastic strap, wherein:

(a) the strap comprises a plurality of loops, each loop having a tubular structure, the plurality of loops being closely and concentrically assembled and configured to cover the pocket; and (b) the pocket is configured to be positioned between the strap and the wrist of a wearer when the wristband is on the wrist.

2. The wristband of claim 1, wherein each loop of the plurality of loops is a discrete, closed loop.

3. The wristband of claim 2, wherein the plurality of loops is two, three, four, five, six, seven, eight, or nine discrete, closed loops.

4. The wristband of claim 1, wherein the plurality of loops comprises two or more contiguous loops formed of a segment of cording.

5. The wristband of claim 1, wherein the plurality of loops is assembled in parallel relation to form the strap, the strap thereby comprising a parallel portion.

6. The wristband of claim 1, wherein at least two loops in the plurality of loops are assembled in cross relation to form the strap, the strap thereby comprising one or more criss-crosses.

7. The wristband of claim 1, wherein at least one loop in the plurality of loops comprises two or more segments of cording assembled to form the at least one loop.

8. The wristband of claim 1, wherein the strap, the pocket, or the strap and the pocket comprise spandex, nylon or spandex and nylon.

9. The wristband of claim 1, the strap, the pocket, or the strap and the pocket comprise a polyester-spandex blend.

10. The wristband of claim 1, wherein the strap, the pocket, or the strap and the pocket comprise a 4-way stretch material.

11. The wristband of claim 1, wherein the pocket comprises an outward facing slot through which a small item can be inserted into the pocket.

12. The wristband of claim 11, wherein the outward facing slot is beneath of one or more loops in the plurality of loops.

13. The wristband of claim 1, wherein the pocket comprises a slot disposed along a portion of an edge of the pocket to enable a small item to be inserted into the pocket.

14. The wristband of claim 1, wherein the pocket comprises a slot configured with a zipper, a hook and loop fastener, one or more snaps, or one or more buttons.

15. The wristband of claim 1, wherein the pocket is affixed to the strap through stitching.

16. The wristband of claim 1, wherein the pocket comprises a swatch of material to which a zipper is stitched, the edges of the swatch of material and the edges of the zipper being co-extensive, the swatch of material and the zipper being stitched along their co-extensive edges to form an internal pocket chamber accessible through the zipper, and wherein the stitching securing the swatch of material and the zipper along their co-extensive edges secures the pocket to the wristband.

17. The wristband of claim 16, which comprises a parallel portion having five parallel loop segments.

18. The wristband of claim 16, which comprises a criss-cross portion.

19. The wristband of claim 16, wherein the zipper opening is disposed beneath a third loop segment or between a second and a third loop segments.

20. The wristband of claim 1, wherein the pocket is sized so as to be hidden by the strap when the wristband is on the wrist of the wearer.

* * * * *